US006394199B1

(12) United States Patent
Skyles et al.

(10) Patent No.: US 6,394,199 B1
(45) Date of Patent: May 28, 2002

(54) NON-CIRCULAR GAUGE REAMING ROW INSERTS

(75) Inventors: Lane P. Skyles, Houston; Billy L. Carwile, Deer Park; William L. May, Houston, all of TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 09/645,235

(22) Filed: Aug. 24, 2000

Related U.S. Application Data

(60) Provisional application No. 60/157,746, filed on Oct. 5, 1999.

(51) Int. Cl.[7] ..... E21B 10/16

(52) U.S. Cl. ..... 175/336; 175/420.1; 175/428; 175/430

(58) Field of Search ..... 175/331, 327, 175/336, 341, 374, 378, 402, 412, 413, 420.1, 426, 428, 430

(56) References Cited

U.S. PATENT DOCUMENTS

| | | | |
|---|---|---|---|
| 3,952,815 A | | 4/1976 | Dysart |
| 4,304,440 A | * | 12/1981 | Posciri |
| 5,145,016 A | | 9/1992 | Estes |
| 5,351,770 A | | 10/1994 | Cawthorne et al. |
| 5,353,885 A | | 10/1994 | Hooper et al. |
| 5,421,423 A | | 6/1995 | Huffstutler |
| 5,542,485 A | | 8/1996 | Pessier et al. |
| 5,671,817 A | | 9/1997 | Smith et al. |
| 5,833,020 A | * | 11/1998 | Portwood et al. |
| 5,890,550 A | | 4/1999 | Swadi et al. |

FOREIGN PATENT DOCUMENTS

| | | | |
|---|---|---|---|
| DE | 0262916 | * | 7/1968 |
| SU | 244980 | | 10/1969 |
| SU | 309110 | | 9/1971 |
| SU | 1488427 | | 6/1989 |

* cited by examiner

*Primary Examiner*—Roger Schoeppel
(74) *Attorney, Agent, or Firm*—Jeffery E. Daly

(57) ABSTRACT

Disclosed is a wear resistant cutting insert for use in rolling cutter drill bits. The insert has a cylindrical shank that is readily fitted in an interfering manner into cylindrical sockets formed in the rolling cutter. The surface of die insert that engages the formation, however, is none-circular, and preferably, oval shaped. To prevent the insert from turning in the socket, a shallow counterbore is formed about the socket that accommodates the shape of the top, non-cylindrical portion of the insert. The depth of the recess is made slightly greater than the length of the shank of the insert so that the load applied to insert during operation is not transmitted through the shank to the bottom of the socket in the cutter.

14 Claims, 2 Drawing Sheets

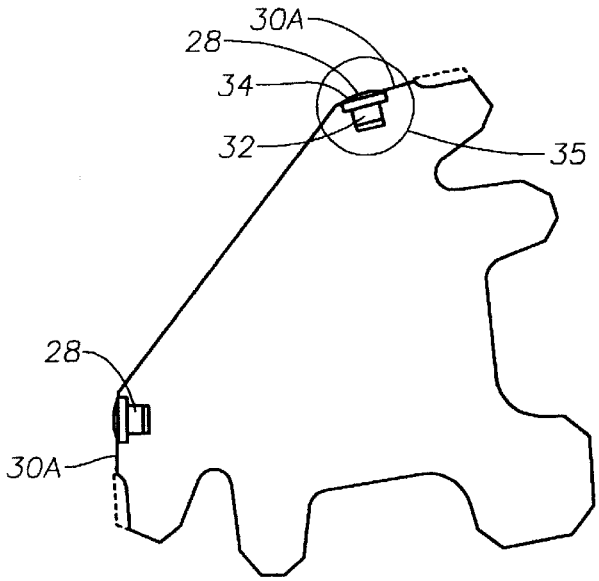
Fig. 3
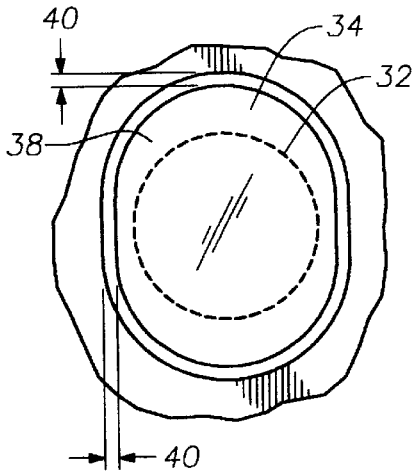
Fig. 6
Fig. 4
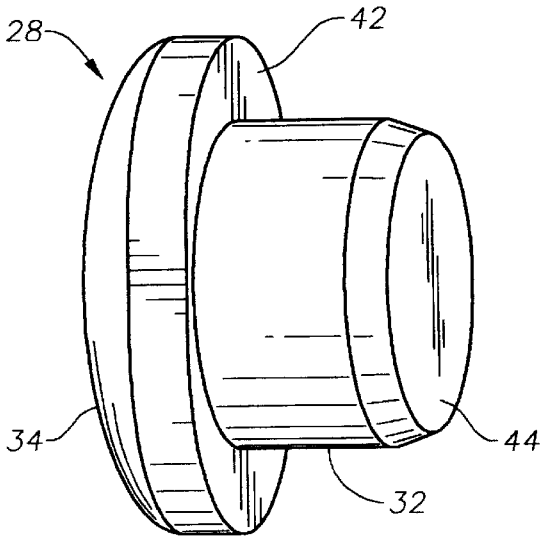
Fig. 5
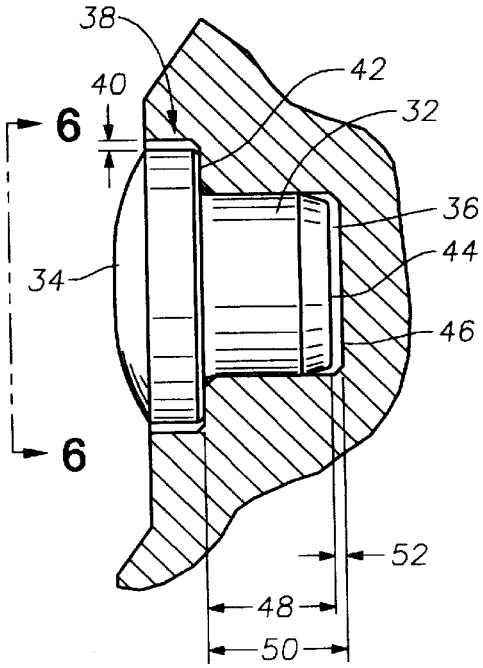

NON-CIRCULAR GAUGE REAMING ROW INSERTS

This Application claims benifit of Provisional No. 60/157,746 filed Oct. 5, 1999.

BACKGROUND OF THE INVENTION

1. Field of the Invention

The invention relates generally to rolling cutter earth boring drill bits used for the exploration and retrieval of petroleum and other minerals from the earth. In particular, the invention is a new form of cutting insert that allows a higher percentage of wear resistant material on the gauge face of the cutter of a rolling cutter earth boring drill bit than previously had been practically possible.

2. Description of the Related Art

The practice of horizontal drilling has had a major impact on modern rolling cutter rock bits. Not only are the bearing systems in these bits challenged in horizontal drilling, the cutting structures, particularly the gauge cutting elements, are severely stressed.

In order to improve the useful life of the gauge cutting elements, the practice of placing multiple rows of gauge reaming inserts on the gauge faces of the rolling cutters has become commonplace. The inserts are usually arranged such that they utilize the maximum amount of the gauge face surface area as possible. To further improve wear resistance, the gauge reaming inserts are often supplied with the wear surfaces coated with diamond or other superhard materials. Some of these gauge surface insert designs are shown in U.S. Pat. Nos. 3,952,895, 5,145,016, 5,351,770, 5,353,885, 5,542,485, and 5,671,817.

A limitation in all these designs, however, is that the amount of wear resistant material exposed at the surface is limited by the round shape of the insert. Since these inserts are interferingly fitted into sockets in the rolling cutter, their placement is profoundly affected by the locations of the other inserts in the cutter. The placement limitations reduce the total amount of wear resistant material that may be placed on the gauge face portion of the rolling cutter.

One way to address the placement problem is to utilize non-circular inserts as shown in U.S. Pat. Nos. 5,421,423 and 5,890,550. The problem with non-circular inserts is that it is difficult and expensive to make non-circular holes in the rolling cutter that will properly retain the inserts. Although non-circular inserts are shown which are interferingly fitted into sockets in a rolling cutter, they are not in common use due to this difficulty.

BRIEF SUMMARY OF THE INVENTION

The present invention is a wear resistant cutting insert for use in rolling cutter drill bits. The insert has a cylindrical shank that is readily fitted in an interfering manner into cylindrical sockets formed in the rolling cutter. The surface of the insert that engages the formation, however, is non-circular, and preferably, oval shaped. To prevent the insert from turning in the socket, a shallow counterbore is formed about the socket that accommodates the shape of the top, non-cylindrical portion of the insert. The depth of the recess is made slightly greater than the length of the shank of the insert so that the load applied to insert during operation is not transmitted through the shank to the bottom of the socket in the cutter.

BRIEF DESCRIPTION OF THE DRAWINGS

FIG. 3 is a cross-section view of the rolling cutter and cutting insert of a drill bit of the present invention.

FIG. 4 is a perspective view of a cutting insert of the present invention.

FIG. 5 is an enlarged cross-section view of a portion of the rolling cutter of FIG. 3.

FIG. 6 is a top view of the cutting insert shown in FIG. 5 as indicated by section lines 6—6 of FIG. 5.

DETAILED DESCRIPTION OF THE INVENTION AND THE PREFERRED EMBODIMENT

Figure 1:
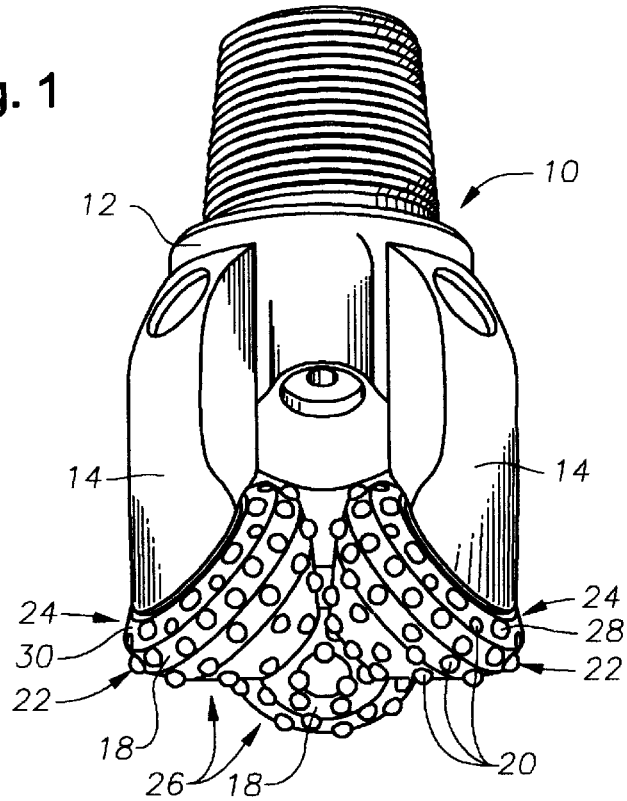
FIG. 1 is a plan view of a rolling cutter drill bit and cutting insert of the present invention.

A perspective view of an insert type rolling cutter drill bit 10 of the present invention is shown in FIG. 1. The rolling cutter drill bit 10 includes a body member 12, and a plurality of downwardly extending legs 14 upon which are rotatably mounted a plurality of rolling cone cutters 18.

Each rolling cone cutter 18 supports a plurality of cutting inserts 20 which are fitted into sockets formed into the surfaces of the cutters 18. Cutting inserts 20 will preferably be formed of a hard, wear resistant material such as tungsten carbide adapted to cut an earthen formation. The inserts 20 are typically arranged in a plurality of rows. The gauge rows are indicated generally at 22, gauge reaming rows are indicated at 24, and the inner rows are indicated generally at 26. The non-circular cutting inserts 28 of the present invention are shown fitted into a gauge reaming row 24.

Figure 2:
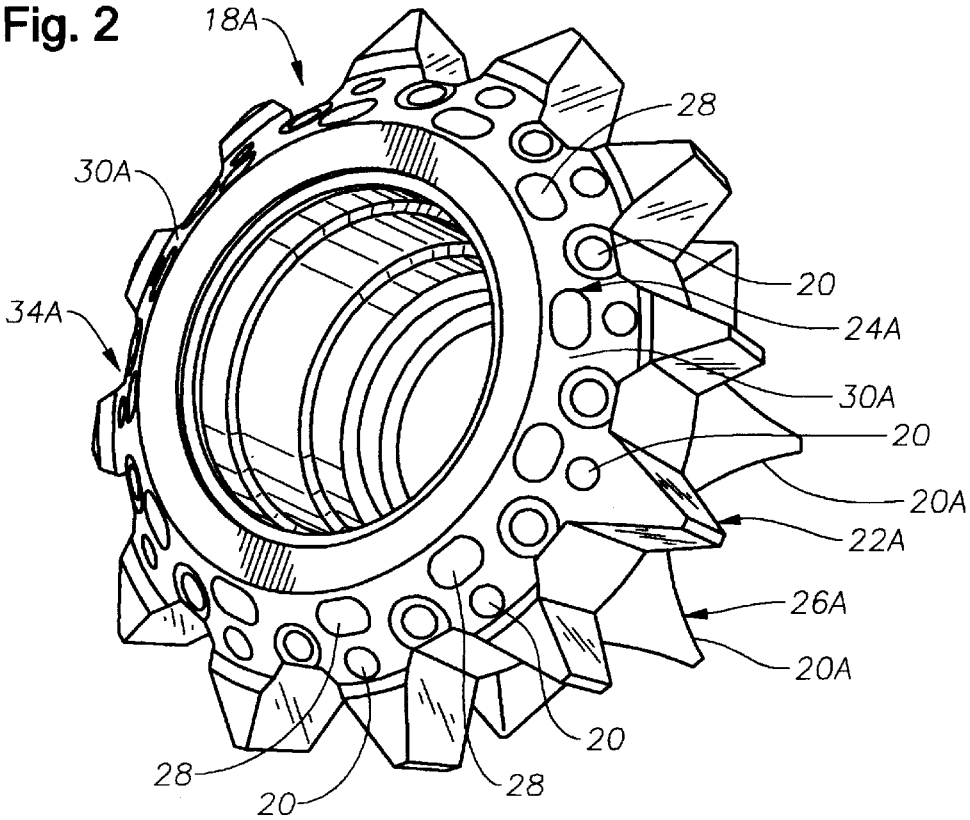
FIG. 2 is a perspective view of an alternate type of rolling cutter that utilizes the cutting insert of the present invention.

Shown in FIG. 2 is an alternate form of rolling cutter 18A. This cutter 18A is used on a type of drill bit known as a tooth type or a steel tooth drill bit. In a tooth type cutter 18A the gauge rows 22A and inner rows 26A of cutting teeth 20A are integrally formed of the steel cutter material and are coated with wear resistant material. The gauge reaming rows(s) 24A are fitted with the non-circular cutting inserts 28 of the present invention.

The reaming row(s) 24, 24A include inserts designed primarily to ream the outermost dimension, or the "gauge", of the borehole after this gauge has been cut by the gauge inserts of the cutters, rows 26, 26A. These reaming rows 24, 24A are located on the gauge face 30, 30A of the cutters 18, 18A, and include the cutting inserts 28 of the present invention, and also conventional circular cutting inserts 20.

Size and placement of reaming row(s) 30, 30A relative to the gauge row 26, 26A have been found to be a critical factor in preventing wear of die gauge inserts 20 or teeth 20A. It has been determined that increasing the area of coverage of the hard, wear resistant gauge reaming inserts 20, 28 reduces the tendency for drill bits 10 to wear under gauge, particularly during directional drilling. The non-circular cutting inserts 28 of the present invention provide a means to increase the amount of wear resistant material on gauge without experiencing the problems of previous designs.

The non-circular cutting inserts 28 of the present invention are shown in more detail in FIGS. 3–6. FIG. 3 shows a cross-section view of the non-circular cutting inserts 28 of the present invention. Although the following description of the non-circular cutting inserts 28 shows and describes them in a tooth type rolling cutter 18A, all the discussion applies equally to non-circular cutting inserts 28 mounted in insert bit cutters 18.

The non-circular cutting inserts 28 are typically mounted in the gauge face 30A of the tooth type cutter 18A shown in FIG. 2, although they may be mounted in other areas of the cutters 18, 18A. The non-circular cutting insert 28 has a shank 32 with a circular cross-section and a non-circular, preferably oval, cutting face 34 larger than the circular cross-section of the shank. The shank 32 and cutting face 34 are more clearly shown in the perspective view of the non-circular cutting insert 28 in FIG. 4, and the enlarged view in FIG. 5 showing the non-circular cutting insert 28 within the circle 35 of FIG. 3.

A socket 36 is formed in the cutter 18, 18A to accommodate the shank 32 of the non-circular cutting insert 28. The socket 36 may be drilled to a diameter slightly less than the shank 32 of the non-circular cutting insert 28 so that the insert 28 is held in place by the resulting interference fit. In addition, a recess 38 is formed in the cutter 18, 18A to accommodate the cutting face 34 of the non-circular cutting insert 28. The gap 40 between the recess 38 in the cutter 18, 18A and die cutting face 34 of the non-circular cutting insert 28 is small, generally between about 0.010 inches and about 0.050 inches, although a gap 40 of about 0.020 inches is preferred. The gap 40 does not need to be uniform about its periphery, and in fact, will usually vary due to the dimensional variations between the parts, and other factors.

The gap 40 limits the amount die non-circular cutting insert 28 can turn within the recess 38 in the cutter 18, 18A. The diameter of the circular cross section of the shank 32 is less than the length and the width of the non-circular cutting face, forming a shoulder portion 42 on the opposite end of the cutting face 34. When the non-circular cutting insert 28 is pressed into the socket 36 in the cutter 18, 18A, the shoulder portion 42 on the opposite end of the cutting face 34 contacts the recess 38 in the cutter 18, 18A. The dimensions of the non-circular cutting insert 28, the recess 38 and the socket 36 in the cutter 18, 18A are such that the end 44 of the non-circular cutting insert 28 does not contact the bottom 46 of the socket 36 in the cutter 18, 18A.

As shown in FIG. 5, the length 48 of the shank 32 of the non-circular cutting insert 28 is less than the depth 50 of the socket 36. This difference forms a bottom gap 52 between the end of the shank 32 and the bottom 46 of the socket. The bottom gap 52 is generally between about 0.010 inches and about 0.050 inches, but a bottom gap of about 0.025 inches is preferred. The bottom gap 52 assures that the non-circular cutting insert 28 is seated against the recess 38 in the cutter 18, 18A. If the non-circular cutting insert 28 were to contact the bottom of the socket 36, the insert 28 would be vulnerable to cracking.

The non-circular cutting inserts 28 will preferably be formed of a hard, wear resistant material such as tungsten carbide adapted to cut an earthen formation. In some cases it may be desirable to coat the cutting face 34 with a diamond, polycrystalline diamond or other superhard material such as a diamond like carbon material (DLC) to further improve wear resistance.

A top view of the non-circular cutting insert 28 in the recess 38, as defined by the sections lines 6 in FIG. 5, is shown in FIG. 6. The cutting face 34 of the non-circular cutting insert 28 as shown is oval in shape to maximize the exposure of surface 34 at the gauge face 30, 30A of the cutter. However, it may be desirable to make other cutting face 34 shapes as design constraints in the drill bit 10 change. For example a triangular shape cutting face 34 of the non-circular cutting inserts 28 may maximize the exposure of face 34 if the gauge face 30, 30A was unusually narrow and close to the inserts 20 on the gauge row 22.

Many various cutting face 34 shapes of the non-circular cutting inserts 28 may be suitable. For example, the cutting face 34 may have non-circular cutting surfaces that interlock with each other, and yet each insert could be fitted in its own socket. The cutting faces 34 of these non-circular inserts 28 would have irregular shapes. In this design, the recess 38 in the gauge face of the cutter could be formed as a continuous grove.

Whereas the present invention has been described in particular relation to the drawings attached hereto, it should be understood that other and further modifications apart from those shown or suggested herein, may be made within the scope and spirit of the present invention.

What is claimed is:

1. A rolling cutter drill bit comprising a body member and a plurality of extending legs, a rolling cone cutter rotatably mounted on at least one extending leg, the rolling cone cutter having a plurality of integrally formed cutting teeth and a plurality of cylindrical sockets formed in a surface of a gauge reaming row, a recess formed in the surface around at least one cylindrical socket on the gauge reaming row, and at least one non-circular cutting insert comprising a shank with a circular cross section and a non-circular cutting face, wherein the shank of the non-circular cutting insert is interferingly fitted into the at least one socket in the gauge reaming row and wherein the recess in the surface of the cutter is adapted to receive the non circular cutting face.

2. The rolling cutter drill bit of claim 1 wherein the recess formed in the surface of the cutter is sized such that a gap is formed between the recess and the non-circular cutting face.

3. The rolling cutter drill bit of claim 2 wherein the gap is between about 0.010 inches and about 0.050 inches.

4. The rolling cutter drill bit of claim 3 wherein the gap is about 0.020 inches.

5. The rolling cutter drill bit of claim 1 wherein the recess formed in the surface of the cutter is a continuous groove about the gauge reaming row.

6. The rolling cutter drill bit of claim 1 wherein the circular cross section of the shank has a diameter and the non-circular cutting face has an opposite end, the non-circular cutting face having a length and a width, wherein the diameter is less than both the length and the width of the non-circular cutting face whereby a ledge is formed about the opposite end of the non-circular cutting face.

7. The rolling cutter drill bit of claim 1 wherein the shank has a bottom surface and a length and the socket has a bottom and a depth, the length of the shank being loss than the depth of the socket whereby a bottom gap is formed between the bottom surface of the shank and the bottom of the socket.

8. The rolling cutter drill bit of claim 7 wherein the bottom gap is between about 0.010 inches and about 0.050 inches.

9. The rolling cutter drill bit of claim 8 wherein the bottom gap is about 0.025 inches.

10. The rolling cutter drill bit of claim 1 wherein the non-circular cutting insert is formed of a hard, wear resistant material.

11. The rolling cutter drill bit of claim 10 wherein the hard, wear resistant material is cemented tungsten carbide.

12. The rolling cutter drill bit of claim 1 wherein the non-circular cutting face is coated with a superhard material to further improve wear resistance.

13. The rolling cutter drill bit of claim 12 wherein the superhard material is polycrystalline diamond.

14. The rolling cutter drill bit of claim 13 wherein the superhard material is a diamond like carbon material.

* * * * *